US011114034B2

(12) United States Patent
Lee et al.

(10) Patent No.: US 11,114,034 B2
(45) Date of Patent: Sep. 7, 2021

(54) DISPLAY DEVICE

(71) Applicant: LG Display Co., Ltd., Seoul (KR)

(72) Inventors: Donggun Lee, Paju-si (KR); Kyujin Kim, Paju-si (KR); Taehun Kim, Paju-si (KR); Seungjin Yoo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/921,251

(22) Filed: Jul. 6, 2020

(65) Prior Publication Data

US 2021/0035502 A1 Feb. 4, 2021

(30) Foreign Application Priority Data

Jul. 29, 2019 (KR) ..... 10-2019-0091990

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01)

(58) Field of Classification Search
CPC .. G09G 3/3233; G09G 3/3291; G09G 3/3258; G09G 3/3266; G09G 3/3648; G09G 3/3241; G09G 3/325; G09G 2300/0819; G09G 2300/0816; G09G 2300/0842; G09G 2300/0852; G09G 2300/0426; G09G 2300/0809; G09G 2300/0814; G09G 2300/043; G09G 2300/0876; G09G 2320/043; G09G 2320/045; G09G 2320/0233; G09G 2320/0223; G09G 2310/0262; G09G 2310/0251; G09G 2310/0297; G09G 2310/0256
See application file for complete search history.

(56) References Cited

U.S. PATENT DOCUMENTS 10,565,931 B2 2/2020 Jung
2005/0285825 A1* 12/2005 Eom ..... G09G 3/3233 345/76

(Continued)

FOREIGN PATENT DOCUMENTS

KR 10-2018-0045902 A 5/2018

*Primary Examiner* — Dong Hui Liang
(74) *Attorney, Agent, or Firm* — Fenwick & West LLP

(57) ABSTRACT

A display device is proposed, the display device including a display panel and a driving circuit, and pixels included in the display panel includes a driving transistor, a light emitting element, a capacitor, and first to sixth switching transistors T1 to T6. T1 senses threshold voltage of the driving transistor, the capacitor stores data voltage and a threshold voltage in both electrodes, T2 applies data voltage to the capacitor, T3 initializes the storage capacitor to reference voltage, and T4 initialize the light emitting element to reference voltage, T5 controls current flow between the driving transistor and the light emitting element, and T6 connects both electrodes of the capacitor. The driving circuit divides one frame into an initialization period, a program period, and a light emission period to drive a pixel, and stops light emission of the light emitting device and make equal voltage across the capacitor, in the initialization period.

11 Claims, 8 Drawing Sheets

(56) References Cited

U.S. PATENT DOCUMENTS

| | | | | |
|---|---|---|---|---|
| 2005/0287750 | A1* | 12/2005 | Lee | H01L 27/124 438/301 |
| 2009/0121981 | A1* | 5/2009 | Yoo | G09G 3/3233 345/76 |
| 2011/0128211 | A1* | 6/2011 | Ono | H01L 27/3265 345/76 |
| 2012/0161637 | A1* | 6/2012 | Lee | G09G 3/32 315/122 |
| 2017/0025062 | A1* | 1/2017 | Wang | G09G 3/3233 |
| 2017/0243542 | A1* | 8/2017 | Xiang | G09G 3/3233 |
| 2018/0114488 | A1 | 4/2018 | Jung | |
| 2018/0233080 | A1* | 8/2018 | Chen | G09G 3/3233 |
| 2019/0122610 | A1* | 4/2019 | Wang | G09G 3/3233 |
| 2020/0135108 | A1* | 4/2020 | Li | G09G 3/3275 |

* cited by examiner

DISPLAY DEVICE

CROSS-REFERENCE TO RELATED APPLICATIONS

This application claims the benefit of Republic of Korea Patent Application No. 10-2019-0091990 filed on Jul. 29, 2019, which is incorporated by reference in its entirety.

BACKGROUND

Field of Technology

The present disclosure relates generally to a display device and, more particularly, to an organic light emitting pixel structure that stabilizes a driving voltage of a pixel to which internal compensation is applied.

Discussion of the Related Art

A flat panel display device includes a liquid crystal display device (LCD), an electroluminescence display, a field emission display (FED), a quantum dot display panel (QD), and the like. The electroluminescent display device is divided into an inorganic light emitting display device and an organic light emitting display device according to the material of the light emitting layer. The pixels of the organic light emitting display device include an organic light emitting diode (OLED), which is a light emitting element that emits light by itself, to display an image by emitting the OLED.

The active matrix type organic light emitting display panel including an OLED has advantages of high response speed, high luminous efficiency, high brightness, and large viewing angle.

The organic light emitting display device has pixels including an OLED and a driving transistor arranged in a matrix form to adjust luminance of an image implemented in a pixel according to gradation of video data. The driving transistor controls a driving current flowing through the OLED according to a voltage applied between its gate electrode and source electrode. An emission amount of the OLED is determined according to the driving current, and the luminance of the image is determined according to the emission amount of the OLED.

As an electrical characteristic of the driving transistor is degraded as time passes, the electrical characteristic may vary from pixel to pixel. Such variation in electrical characteristic between pixels is a major factor that degrades image quality, because the pixels emit light with different luminance even when the same image data is applied to the pixels.

In order to compensate for the variation in electrical characteristics between pixels, an internal compensation method is applied in which an internal compensation circuit composed of a plurality of transistors and capacitors is added to each pixel to sample and compensate the threshold voltage and/or electron mobility of the driving transistor.

However, when the driving voltage, which is the source of supplying an electric current flowing through the OLED of the pixel, or the voltage that initializes the internal components of the pixel is not constant but fluctuates, the compensation effect is reduced and thus the display quality is degraded.

SUMMARY

The embodiments disclosed herein take this situation into consideration, and an objective of this specification is to provide a pixel circuit that stabilizes the voltage supplied to the pixel.

The display device according to an embodiment includes a display panel and a driving circuit, and pixels included in the display panel may include a driving transistor, a light emitting element, a capacitor, and first to sixth switching transistors T1 to T6.

The transistor T1 senses a threshold voltage of the driving transistor, the capacitor stores a data voltage and a threshold voltage in both electrodes, the transistor T2 applies the data voltage to the capacitor, the transistor T3 initializes the storage capacitor to a reference voltage, the transistor T4 initializes the light emitting element to a reference voltage, the transistor T5 controls an electric current flowing between the driving transistor and the light emitting element, and the transistor T6 connects both electrodes of the capacitor.

The driving circuit divides one frame into an initialization period, a program period, and a light emission period to drive a pixel, and stops light emission of the light emitting element to make equal voltage across the storage capacitor in the initialization period.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION

Figure 1:
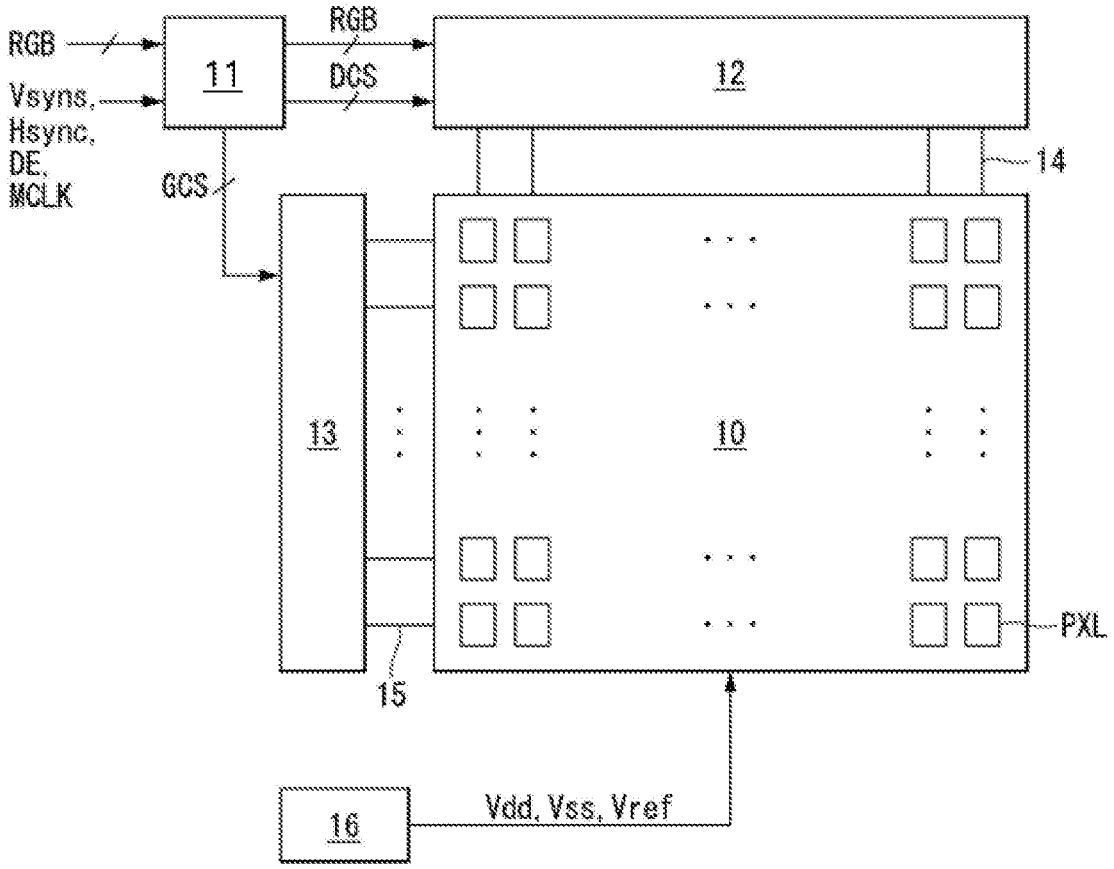
FIG. 1 is a view illustrating an organic light emitting display device as a functional block according to one embodiment.

Hereinafter, the embodiments will be described in detail with reference to the accompanying drawings. Throughout the specification, the same reference numbers refer to substantially the same components. In the following description, when it is determined that a detailed description of a known function or configuration related to the contents of this specification may unnecessarily obscure or interfere with the understanding of contents, the detailed description will be omitted.

In a display device, a pixel circuit and a gate driving circuit may include one or more of an N-channel transistor (NMOS) and a P-channel transistor (PMOS). A transistor is a three-electrode element, including a gate, a source, and a drain. The source is an electrode through which carriers are supplied with the transistor. In the transistor, the carriers begin to flow from the source. The drain is an electrode through which carriers move out of the transistor. In the transistor, the carriers flow from source to drain. In the case of an N-channel transistor, since the carrier is an electron, the source voltage has a voltage lower than the drain voltage so that the electron may flow from source to drain. In the N-channel transistor, currents flow from drain to source. In the case of a P-channel transistor, since the carrier is a hole, the source voltage is higher than the drain voltage so that the hole may flow from source to drain. In the P-channel transistor, since the holes flow from source to drain, electric currents flow from source to drain. It should be noted that the source and drain of the transistor are not fixed. For example, the source and drain may be changed according to the applied voltage. Therefore, the invention is not limited due to the source and drain of the transistor. In the following description, the source and drain of the transistor will be referred to as a first electrode and a second electrode, respectively.

The scan signal (or gate signal) applied to the pixels swings between a gate-on voltage and a gate-off voltage. The gate-on voltage is set to a voltage higher than the transistor's threshold voltage, and the gate-off voltage is set to a voltage lower than the transistor's threshold voltage. The transistor is turned on in response to the gate-on voltage, while the transistor is turned off in response to the gate-off voltage. In the case of an N-channel transistor, the gate-on voltage may be a gate high voltage VGH, and the gate-off voltage may be a gate low voltage VGL. In the case of a P-channel transistor, the gate-on voltage may be a gate low voltage VGL, and the gate-off voltage may be a gate high voltage VGH.

Each pixel of the organic light emitting display device includes an OLED, which is a light emitting element, and a driving element that drives the OLED by supplying an electric current to the OLED according to a voltage Vgs between the gate and source. The OLED includes an anode electrode, a cathode electrode, and an organic compound layer formed between these electrodes. The organic compound layer includes a hole injection layer (HIL), a hole transport layer (HTL), an emission layer (EML), an electron transport layer (ETL), an electron injection layer (EIL), and the like, but not limited thereto. When electric current flows through the OLED, holes passing through the hole transport layer (HTL) and electrons passing through the electron transport layer (ETL) move to the emission layer (EML) to form excitons, whereby the emission layer (EML) may emit visible light.

The driving element may be implemented with a transistor such as a metal oxide semiconductor field effect transistor (MOSFET). Although the driving transistor should have uniform electrical characteristics between pixels, the driving transistor may have a variation in electrical characteristics between pixels due to a variation in process parameters and a variation in element characteristics and may vary over driving time of the display. An internal compensation method and/or an external compensation method may be applied to the organic light emitting display device to compensate for the variation in electrical characteristics of the driving transistor. The internal compensation method is applied in embodiments described below.

FIG. 1 is a block diagram illustrating an organic light emitting display device. The display device of FIG. 1 may include a display panel 10, a timing controller 11, a data driving circuit 12, a gate driving circuit 13, and a power supply unit 16.

All or some of the timing controller 11, the data driving circuit 12, the gate driving circuit 13, and the power supply unit 16 of FIG. 1 may be integrated in a drive IC 30.

On a screen where an input image is displayed in the display panel 10, a plurality of data lines 14 arranged in a column direction (or vertical direction) and a plurality of gate lines 15 arranged in a row direction (or horizontal direction) intersect with each other, and pixels PXL are arranged in a matrix form for each intersection area, thereby forming a pixel array.

The gate lines 15 apply a data voltage supplied to the data line 14 to the pixels, and supply a scan signal, a light emission signal, and the like for emitting the pixels to the pixels.

The display panel 10 may further include a first power line for supplying a pixel driving voltage (or high potential power voltage) Vdd to the pixels PXL, a second power line for supplying a low potential power voltage Vss to the pixels PXL, and a reference voltage line for supplying a reference voltage Vref for initializing the pixel circuit, and the like. The first/second power line and the reference voltage line are connected to the power supply unit 16. The second power line may be formed in the form of a transparent electrode covering a plurality of pixels PXL.

Touch sensors may be disposed on the pixel array of the display panel 10. The touch input may be detected using separate touch sensors or may be detected through the pixels. The touch sensors may be placed on a screen AA of the display panel PXL in an on-cell type or an add-on type, or implemented with in-cell type touch sensors embedded in the pixel array.

In the pixel array, pixels PXL disposed on the same horizontal line are connected to any one of the data lines 14 and any one of the gate lines 15 to form a pixel line. The pixel PXL is electrically connected to the data line 14 in response to the scan signal and the light emission signal applied through the gate line 15 to receive the data voltage and emit the OLED with an electric current corresponding to the data voltage. The pixels PXL disposed in the same pixel line operate simultaneously according to the scan signal and the light emission signal applied from the same gate line 15.

One-pixel unit may be composed of three subpixels including a red subpixel, a green subpixel, and a blue subpixel, or four subpixels including a red subpixel, a green subpixel, a blue subpixel, and a white subpixel, but is not limited to thereto. Each sub-pixel may be implemented with a pixel circuit including an internal compensation circuit. Hereinafter, a pixel means a subpixel.

Figure 2:
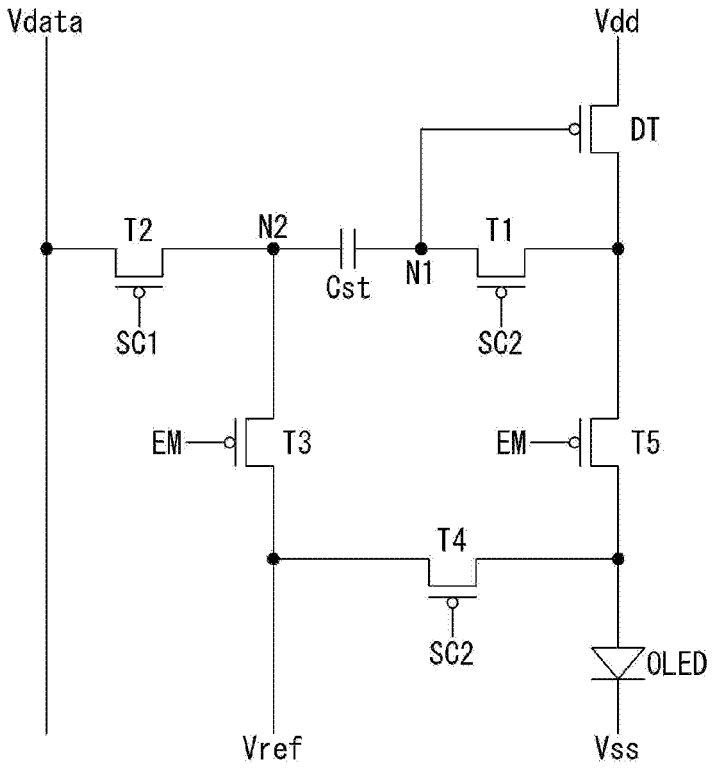
FIG. 2 is a view illustrating a pixel circuit composed of six transistors and one capacitor according to one embodiment.
Figure 5:
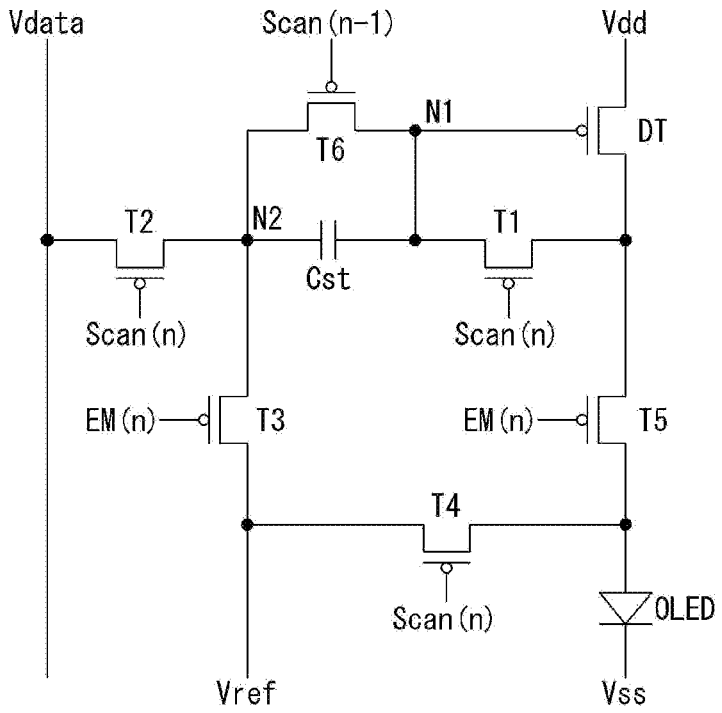
FIG. 5 is a view illustrating a pixel circuit composed of seven transistors and one capacitor according to one embodiment.

The pixel PXL receives a pixel driving voltage Vdd, a reference voltage Vref, and a low potential power supply voltage Vss from the power supply unit 16, and may include a driving transistor, an OLED, and an internal compensation circuit as shown in FIG. 2 or FIG. 5.

The timing controller 11 supplies image data RGB transmitted from an external host system (not shown) to the data driving circuit 12. The timing controller 11 receives timing signals such as a vertical synchronization signal Vsync, a horizontal synchronization signal Hsync, a data enable signal DE, and a dot clock (DCLK) from the host system, and creates control signals for controlling operation timings of the data driving circuit 12 and the gate driving circuit 13. The control signals include a gate timing control signal GCS for controlling the operation timing of the gate driving circuit 13 and a data timing control signal DCS for controlling the operation timing of the data driving circuit 12.

The data driving circuit 12 samples and latches digital video data RGB input from the timing controller 11 to be changed into parallel data on the basis of the data control signal DCS, and converts the same into analogue data voltage to be output to the data lines 14 according to a gamma reference voltage through channels. The data voltage may be a value corresponding to a grayscale that is to be represented by a pixel. The data driving circuit 12 may be composed of a plurality of drivers IC When the gate driving circuit 13 creates a scan signal and a light emission signal on the basis of the gate control signal GCS, the gate driving circuit 13 creates the scan signal and the light emission signal in a row sequential manner during an active period and sequentially provides the same to the gate line 15 connected to each pixel line. The scan signal and the light emission signal from the gate line 15 are synchronized with the supply of the data voltage from the data line 14. The scan signal and the emission signal swing between a gate-on voltage VGL and a gate-off voltage VGH. The gate-on voltage VGL and the gate-off voltage VGH may be set to VGH=8V and VGL=−7V, but are not limited thereto.

The gate driving circuit 13 may be configured with multiple gate drive integrated circuits that each includes a shift register, a level shifter for converting the output signal of the shift register to a swing width suitable for driving a TFT of the pixel, an output buffer, etc. Alternatively, the gate driving circuit 13 may be directly formed on the lower substrate of the display panel 10 by a gate drive IC in panel (GIP) method. In the case of the GIP method, the level shifter is mounted on a printed circuit board (PCB), and the shift register may be formed on the lower substrate of the display panel 10.

The power supply unit 16 adjusts a DC input voltage provided from the host using a DC-DC converter, to generate a gate-on voltage VGL and a gate-off voltage VGH required for operating the data driving circuit 12 and the gate driving circuit 13, and to generate a pixel driving voltage Vdd, a reference voltage Vref, and a low potential power supply voltage Vss required for driving the pixel array.

The host system may be an application processor (AP) in a mobile device, a wearable device, and a virtual/augmented reality device. Alternatively, the host system may be a main board such as a television system, a set top box, a navigation system, a personal computer, a home theater system, and the like, but is not limited thereto.

FIG. 2 shows a pixel circuit composed of six transistors and one capacitor, in which an internal compensation circuit is included.

A pixel circuit of FIG. 2 is configured to include a driving transistor DT, an OLED, five switching transistors T1 to T5, and a storage capacitor Cst. In the pixel circuit of FIG. 2, the transistor is implemented as a P-channel transistor, but is not limited thereto.

Since the driving transistor is a P-channel transistor, a gate-on voltage to turn on the transistor is a gate low voltage VGL, and a gate-off voltage to turn off the transistor is a gate high voltage VGH.

The first switching transistor T1 serves to sense a threshold voltage of the driving transistor by connecting a second electrode and a gate electrode of the driving transistor DT, and has a gate electrode receiving a second scan signal SC2, one of a first electrode and a second electrode connected to the gate electrode (first node N1) of the driving transistor DT, and the other connected to the second electrode of the driving transistor DT.

The second switching transistor T2 serves to apply a data voltage Vdata of the data line 14 to the storage capacitor Cst and has a gate electrode receiving a first scan signal SC1, a first electrode connected to the data line 14, and a second electrode connected to a first electrode (second node N2) of the storage capacitor Cst.

The third switching transistor T3 serves to initialize the second node N2 to the reference voltage Vref prior to the application of the data voltage Vdata and after the application of the data voltage Vdata and has a gate electrode receiving a light emission signal (EM), one of the first electrode and the second electrode connected to the second node (N2), and the other receiving a reference voltage (Vref).

The fourth switching transistor T4 serves to initialize an anode electrode of the OLED and has a gate electrode receiving a second scan signal SC2, one of a first electrode and a second electrode connected to the anode electrode of the OLED, and the other receiving a reference voltage Vref.

The fifth switching transistor T5 serves to control an electric current created in the driving transistor DT and flowing to the OLED, and has a gate electrode receiving the light emission signal EM, and a first electrode connected to the second electrode of the driving transistor DT, and a second electrode connected to the anode electrode of the OLED.

The driving transistor DT serves to generate an electric current to emit the OLED corresponding to the data voltage Vdata and has a gate electrode connected to the first node N1, and a first electrode receiving the pixel driving voltage Vdd, and a second electrode connected to the first electrode or the second electrode of the first switching transistor T1 or the fifth switching transistor T5.

The OLED emits light according to the electric current generated by the driving transistor DT and has an anode electrode connected to the first electrode or the second electrode of the fourth switching transistor T4 or the fifth switching transistor T5 and a cathode electrode receiving a low potential power supply voltage Vss.

Figure 3:
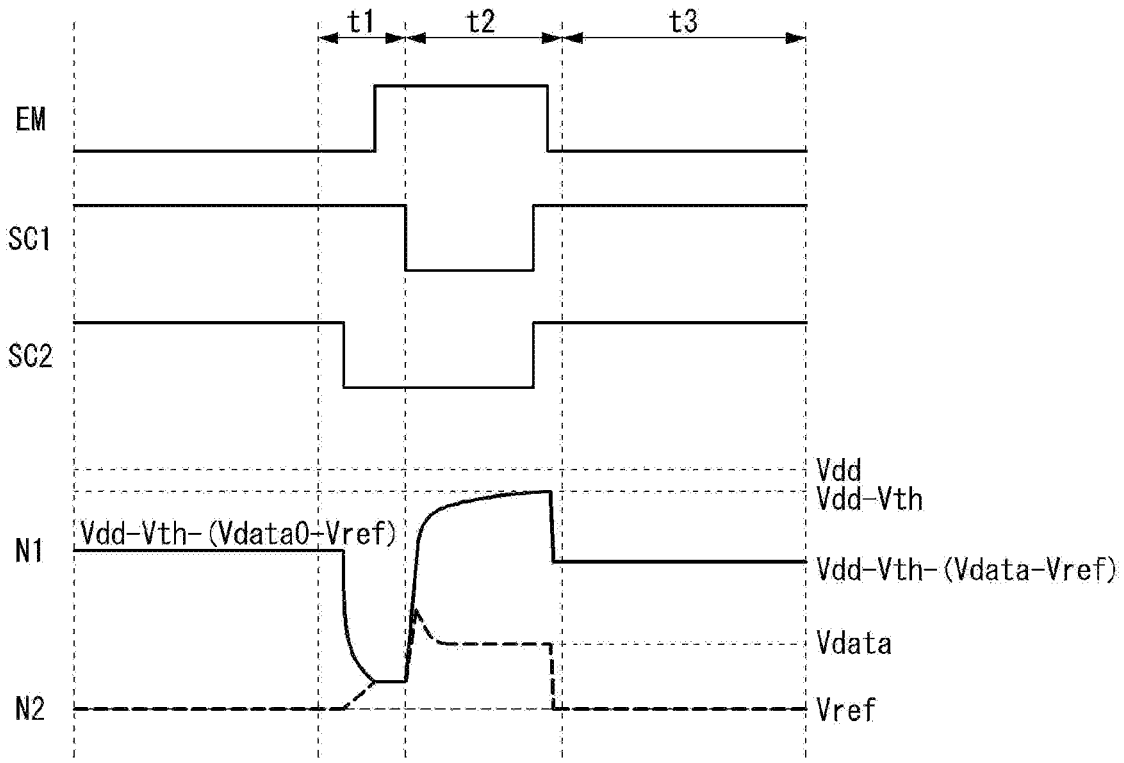
FIG. 3 is a view illustrating signals related to driving of a pixel circuit of FIG. 2 according to one embodiment.

FIG. 3 shows signals related to driving of the pixel circuit of FIG. 2, in which the pixel circuit of FIG. 2 is controlled by the first and second scan signals SC1 and SC2 and the emission signal EM.

The pixel circuit of FIG. 2 is driven by dividing one frame into an initialization period t1, a program period t2, and a light emission period t3.

The initialization period t1 is a time for initializing the main components of the pixel in order to receive the data voltage Vdata of the current frame, in the state that the OLED of the pixel is emitting light with a data voltage Vdata0 of the previous frame.

In the initialization period t1, the emission signal EM maintains a gate low voltage VGL, which is a gate on voltage, and then is changed to a gate high voltage VGH at the end of the initialization period; the first scan signal SC1 maintains the gate high voltage VGH, which is a gate off voltage; and the second scan signal SC2 is changed from the gate-high voltage VGH, which is the gate off voltage, to the gate-low voltage VGL, which is the gate on voltage.

Accordingly, the third and fifth switching transistors T3 and T5 maintain a turn-on state, the second transistor T2 maintains a turn-off state, and the first and fourth switching transistors T1 and T4 is changed from a turn-off state to a turn-on state.

At the end of the initialization period t1, the light emission signal EM is changed from the gate low voltage VGL, which is the gate-on voltage, to the gate high voltage VGH, which is the gate-off voltage, which occurs for a short time between the initialization period t1 and the program period t2.

The pixel circuit of FIG. 2 maintains the light emission state of the previous frame until the second scan signal SC2 is the gate high voltage VGH, which is the gate off voltage, in the beginning of the initialization period t1, so that the first node N1 maintains a predetermined voltage and the second node N2 is connected to the reference voltage line through the third switching transistor T3 in a turn-on state to maintain the reference voltage Vref. For example, when the data voltage applied to the previous frame is Vdata0, the first node N1 maintains (Vdd−Vth−(Vdata0−Vref)), where Vth is a threshold voltage of the driving transistor DT.

In the initialization period t1, when the second scan signal SC2 is changed from the gate high voltage VGH, which is the gate-off voltage, to the gate low voltage VGL, which is the gate-on voltage, the first and fourth switching transistors T1 and T4 are turned on, so that the second electrode and the gate electrode (or first node N1) of the driving transistor DT are connected by the first switching transistor T1, i.e., the driving transistor DT is diode-connected to maintain a turn-on state, and the anode electrode of the OLED is initiated to the reference voltage Vref by the fourth switching transistor T4. The anode electrode of the OLED is initialized to the reference voltage Vref set lower than the threshold voltage of the OLED, so that the OLED stops emitting light.

Herein, the driving transistor DT and the first and third to fifth switching transistors T1 and T3 to T5 are turned on, so that the first power supply line for supplying the pixel driving voltage Vdd is substantially connected to the reference voltage line supplying the reference voltage Vref via the driving transistor DT and the fifth switching transistor T5 to form a current path, and the first node N1 and the second node N2 are also connected to the corresponding current path through the first switching transistor T1 and the third switching transistor T3, respectively. Accordingly, the first node N1 and the second node N2 are equal to each other at an arbitrary voltage between the pixel driving voltage Vdd and the reference voltage Vref, and the storage capacitor Cst is in a state where there is no potential difference between both electrodes.

Thereafter, when the emission signal EM is changed from the gate low voltage VGL, which is the gate-on voltage, to the gate high voltage VGL, which is the gate-off voltage, the third and fifth switching transistors T3 and T5 are turned off, the first node N1 is increased in voltage by the driving transistor DT that is turned on in a diode-connected state, and the second node N2 is disconnected to be in a floating state so that the voltage thereof is raised according to the electrode of the first node N1 by the storage capacitor Cst having no potential difference between both electrodes.

The program period t2 is a period in which the storage capacitor Cst stores the threshold voltage Vth of the driving transistor DT and the data voltage Vdata in both electrodes, that is, the first node N1 and the second node N2, respectively.

In the program period t2, the emission signal EM maintains the gate high voltage VGH, which is the gate-off voltage, and then is changed to the gate low voltage VGL at the end of the program period; the first scan signal SC1 is changed from a gate high voltage VGH, which is a gate-off voltage, to a gate low voltage VGL, which is a gate-on voltage, and then changed to a gate high voltage (VGH) at the end of the program period; and the second scan signal SC2 maintains the gate low voltage VGL, which is the gate-on voltage, and then is changed to the gate high voltage (VGH) at the end of the program period.

Accordingly, the third and fifth switching transistors T3 and T5 maintain a turn-off state, the second transistor T2 is changed from a turn-off state to a turn on state, and the first and fourth switching transistors T1 and T4 maintain a turn-on state.

In the program period t2, the data voltage Vdata of the data line 14 is applied to the second node N2 by the second switching transistor T2 that is turned on, so that the voltage of the second node N2, which increases as the voltage of the first node N1 increases through the storage capacitor Cst, is fixed to Vdata and, the voltage of the first node N1 is increased by the driving transistor DT that is turned on in a diode-connected state to be a value Vdd−Vth that is obtained by subtracting the threshold voltage Vth of the driving transistor DT from the pixel driving voltage Vdd.

Charges corresponding to a difference between the data voltage Vdata and (Vdd−Vth) are stored in both electrodes of the storage capacitor Cst.

The emission period t3 is a period in which the OLED emits light with an electric current corresponding to a voltage difference between the source electrode and the gate electrode of the driving transistor DT while applying the data voltage Vdata to the gate electrode of the driving transistor DT.

In the light emission period t3, the light emission signal EM is changed from a gate high voltage VGH, which is a gate-off voltage, to a gate low voltage VGL, which is a gate-on voltage; the first scan signal SC1 is changed from a gate low voltage VGL, which is a gate-on voltage, to a gate high voltage VGH which is a gate-off voltage; and the second scan signal SC2 is also changed from a gate low voltage VGL, which is a gate-on voltage, to a gate high voltage VGH, which is a gate-off voltage.

Accordingly, the third and fifth switching transistors T3 and T5 are turned on, and the first, second, and fourth switching transistors T1, T2, and T4 are turned off. The third switching transistor T3 is turned on, so that the second node N2 is changed from the data voltage Vdata to the reference voltage Vref. Since the second electrode (second node N2) of the storage capacitor Cst is changed from the data voltage Vdata to the reference voltage Vref, the voltage of the first node N1 connected to the first electrode of the storage capacitor Cst is also changed by the amount of change (Vdata−Vref) in the voltage of the second node N2, to be changed from (Vdd−Vth) to (Vdd−Vth−(Vdata−Vref)).

The fifth switching transistor T5 is turned on to form a current path between the driving transistor DT and the OLED, and an electric current corresponding to a voltage difference between the gate electrode (first node N1) and the first electrode (or source electrode) of the driving transistor DT and is applied to the OLED to emit the OLED.

Since a voltage value of the first electrode, which is a source electrode of the driving transistor DT, is Vdd, and a voltage value of the first node N1, which is a gate electrode, is (Vdd−Vth−(Vdata−Vref)), a source-gate voltage Vsg of the driving transistor DT becomes (Vdd−(Vdd−Vth−(Vdata−Vref)))=(Vdata+Vth−Vref).

An electric current I_OLED flowing in the driving transistor DT is proportional to a square of a value obtained by subtracting the threshold voltage Vth from the source-gate voltage Vsg, which may be expressed as Equation 1 below.

$$I_OLED \propto (Vsg-Vth)^2=(Vdata+Vth-Vref-Vth)^2=(Vdata-Vref)^2 \quad \text{[Equation 1]}$$

As shown in Equation 1, since the threshold voltage Vth component of the driving transistor DT is subtracted in the relational equation of the driving current I_OLED, even when the threshold voltage of the driving transistor DT changes, the OLED may emit light with an electric current corresponding to the data voltage Vdata input through the data line while compensating for the threshold voltage.

Figure 4:
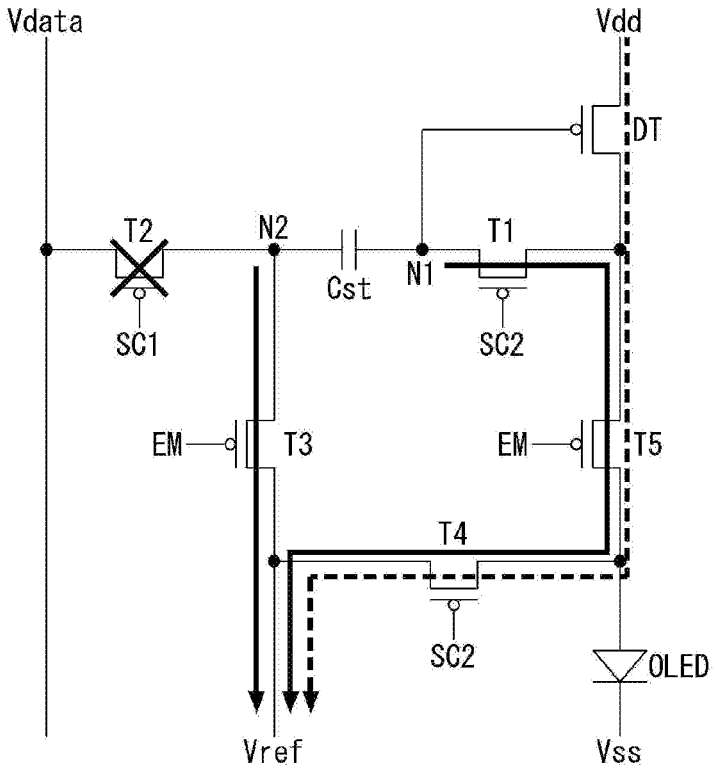
FIG. 4 is a view illustrating the occurrence of a short circuit current in a pixel circuit of FIG. 2 according to one embodiment.

Meanwhile, FIG. 4 is a view illustrating the occurrence of a short circuit current in the pixel circuit of FIG. 2, in which a state during the initialization period t1 is shown.

Since the driving transistor DT and the remaining switching transistors T1, T3, T4, and T5 except the second switching transistor T2 are all turned-on, so that the first power line supplying the pixel driving voltage Vdd is connected to the reference power line supplying the reference voltage Vref through the driving transistor DT, the fifth switching transistor T5, and the fourth switching transistor T4, the first node N1 is also connected to the reference power line through the first, fifth, and fourth switching transistors T1, T5, and T4, and the second node N2 is also connected to the reference power line through the third switching transistor T3. Accordingly, the first node N1 and the second node N2 converge to an arbitrary voltage between the pixel driving voltage Vdd and the reference voltage Vref.

However, as the pixel driving voltage Vdd and the reference voltage Vref are short-circuited, so that as a short circuit current flows, the pixel driving voltage Vdd and the reference voltage Vref supplied to the display panel 10 may fluctuate.

In a situation in which pixels in other horizontal lines is emitting the OLED with an electric current proportional to (Vdata−Vref)2, when a ripple is generated for a short time in a reference voltage Vref supplied to the display panel 10, the luminance of the pixels that are already emitting light changes for a short time, which may cause a user to perceive that the entire screen is blinking.

FIG. 5 is a view illustrating a pixel circuit composed of seven transistors and one capacitor, in which a first power line supplying a pixel driving voltage and a reference power line supplying a reference voltage may be prevented from being disconnected in the pixel circuit of FIG. 2 during the initialization period.

The pixel circuit of FIG. 5 is configured to include a driving transistor DT, an OLED, six switching transistors T1 to T6, and a storage capacitor Cst. In the pixel circuit of FIG. 5, the transistor is implemented as a P-channel transistor, but is not limited thereto.

The pixel circuit of FIG. 5 is different from the pixel circuit of FIG. 2 in that a sixth switching transistor T6 is further included, and control signals for controlling the first and fourth switching transistors T1 and T4 in FIG. 5 are different from those in FIG. 2.

In order to control the first and fourth switching transistors T1 and T4, the first scan signal SC1 and the second scan signal SC2 in which the turn-on period partially overlaps are used in FIG. 2, whereas a scan signal Scan(n) for controlling the second switching transistor T2 for application of the data voltage Vdata is used in FIG. 5.

Since the newly added sixth switching transistor T6 is controlled by using a scan signal Scan(n−1) applied to a pixel of the neighboring previous horizontal line as it is, it is not necessary to supply two different control signals to each pixel to control the switching transistors included in the pixel circuit as shown in FIG. 2.

In FIG. 5, the first switching transistor T1 serves to sense a threshold voltage of the driving transistor by connecting a second electrode and a gate electrode of the driving transistor DT, and has a gate electrode receiving a scan signal Scan(n) supplied to the corresponding horizontal line, one of a first electrode and a second electrode connected to the gate electrode (first node N1) of the driving transistor DT, and the other connected to the second electrode of the driving transistor DT.

The second switching transistor T2 serves to apply a data voltage Vdata of the data line 14 to the storage capacitor Cst and has a gate electrode receiving a scan signal Scan(n), and a first electrode connected to a data line 14, and a second electrode connected to a first electrode (second node N2) of the storage capacitor Cst.

The third switching transistor T3 serves to initialize the second node N2 to the reference voltage Vref after the application of the data voltage Vdata and has a gate electrode receiving a light emission signal EM, one of the first electrode and the second electrode connected to the second node N2, and the other receiving a reference voltage Vref.

The fourth switching transistor T4 serves to initialize an anode electrode of the OLED and has a gate electrode receiving the scan signal Scan(n), one of a first electrode and a second electrode connected to the gate electrode of the driving transistor DT, and the other receiving a reference voltage Vref.

The fifth switching transistor T5 serves to control an electric current generated in the driving transistor DT and flowing to the OLED, and has a gate electrode receiving the light emission signal EM, and a first electrode connected to the second electrode of the driving transistor DT, and a second electrode connected to the anode electrode of the OLED.

The sixth switching transistor T6 serves to initialize the first node N1 and the second node N2 to have the same voltage by connecting both ends of the storage capacitor Cst prior to supply of the data voltage Vdata, and has a gate electrode receiving a scan signal Scan(n−1) of a previous horizontal line, one of a first electrode and a second electrode connected to the first node N1, and the other connected to the second node N2.

The driving transistor DT serves to generate an electric current to emit the OLED in correspondence with the data voltage Vdata and has a gate electrode connected to the first node N1, and a first electrode receiving the pixel driving voltage Vdd, and a second electrode connected to the first electrode or the second electrode of the first switching transistor T1 or the fifth switching transistor T5.

The OLED emits light with an electric current generated according to a voltage between gate and source of the driving transistor DT, and has an anode electrode connected to the first electrode or the second electrode of the fourth switching transistor T4 or the fifth switching transistor T5 and a cathode electrode receiving a low potential power supply voltage Vss.

Figure 6:
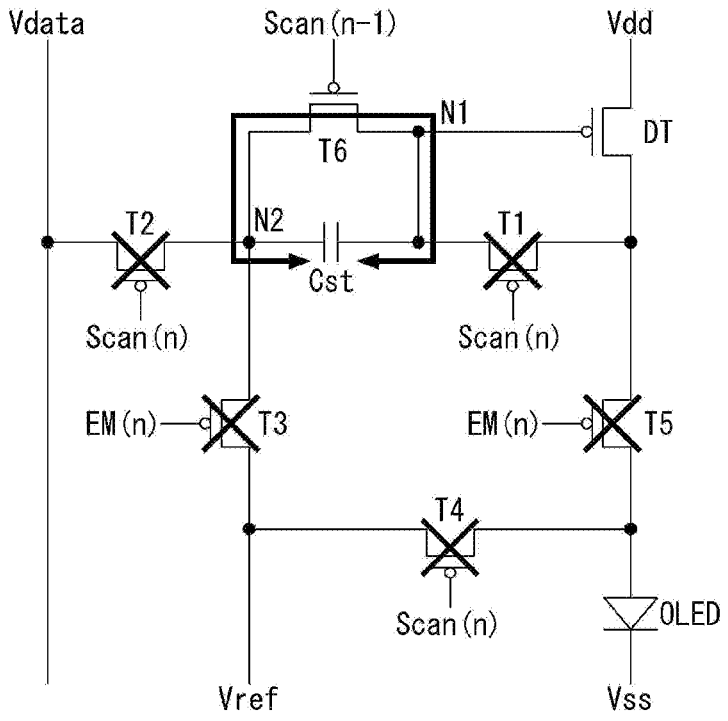
FIG. 6 is a view illustrating an initialization step of initializing a pixel circuit of FIG. 5 according to one embodiment.
Figure 6:
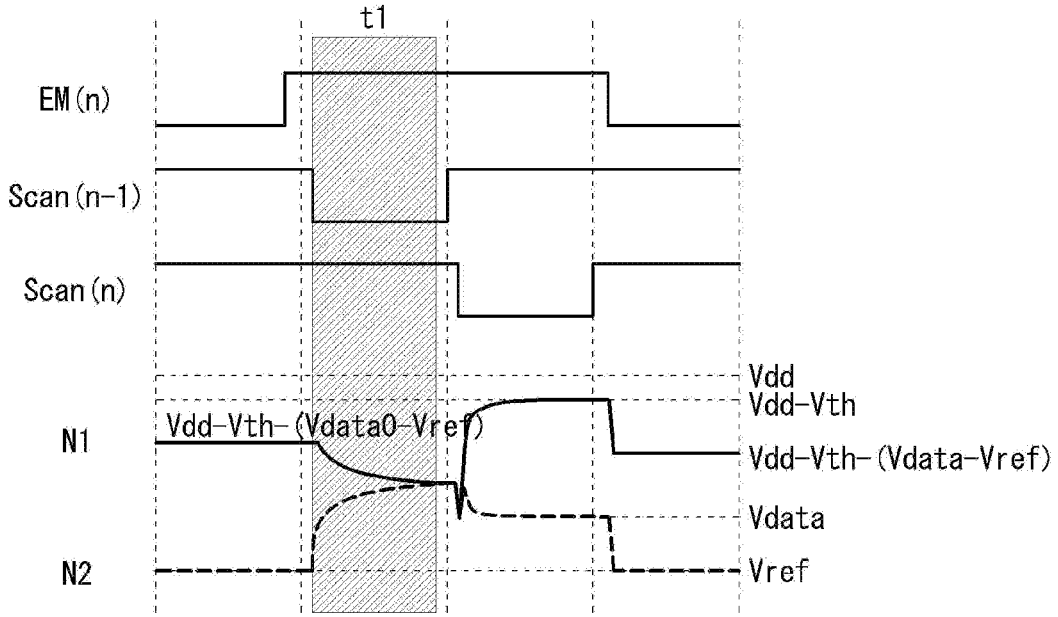
Figure 7:
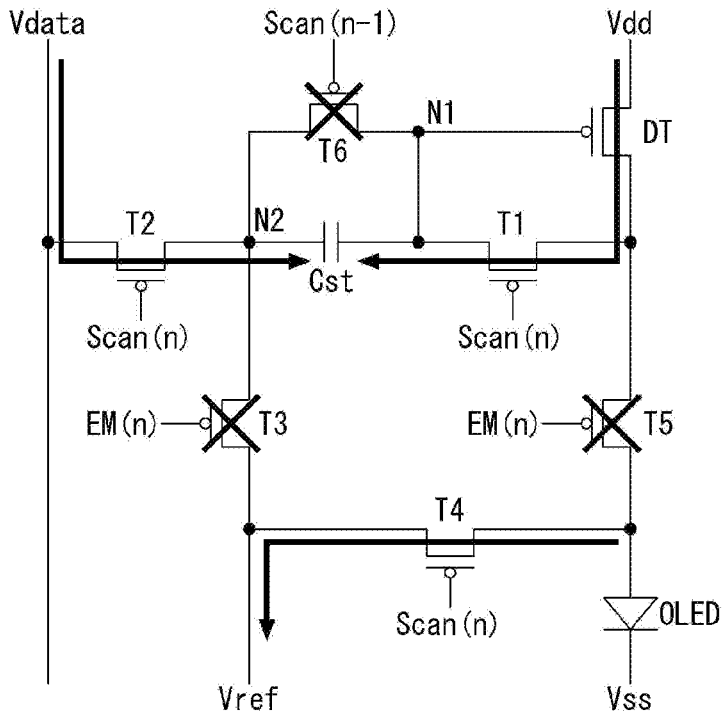
FIG. 7 is a view illustrating a program step of writing data to a pixel circuit of FIG. 5 and storing a threshold voltage of a driving transistor according to one embodiment.
Figure 7:
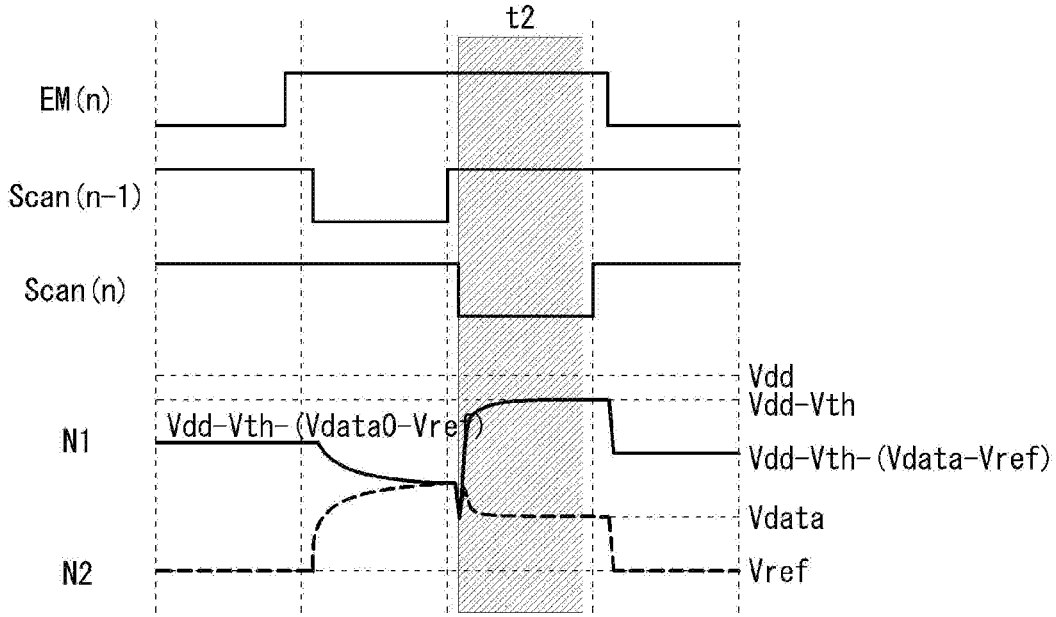
Figure 8:
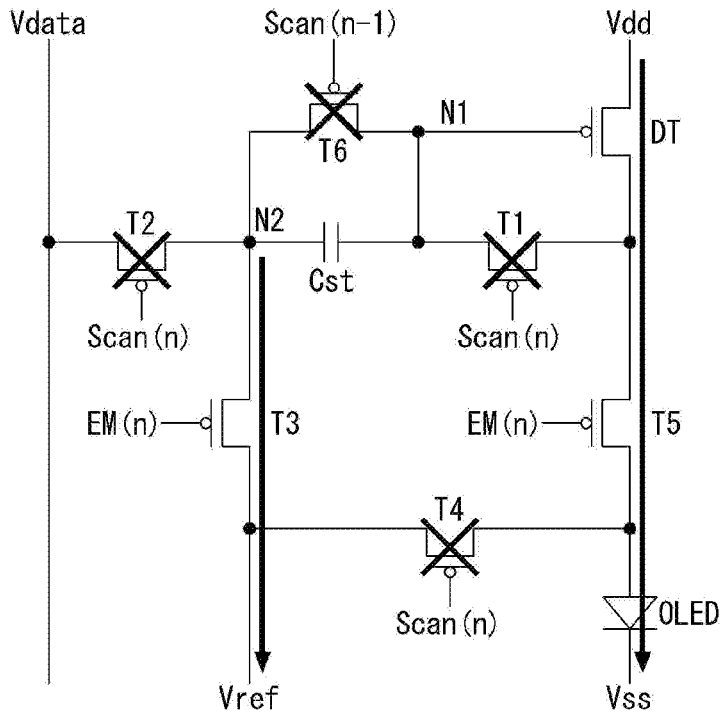
FIG. 8 is a view illustrating a light emission step of emitting a pixel circuit of FIG. 5 according to one embodiment.
Figure 8:
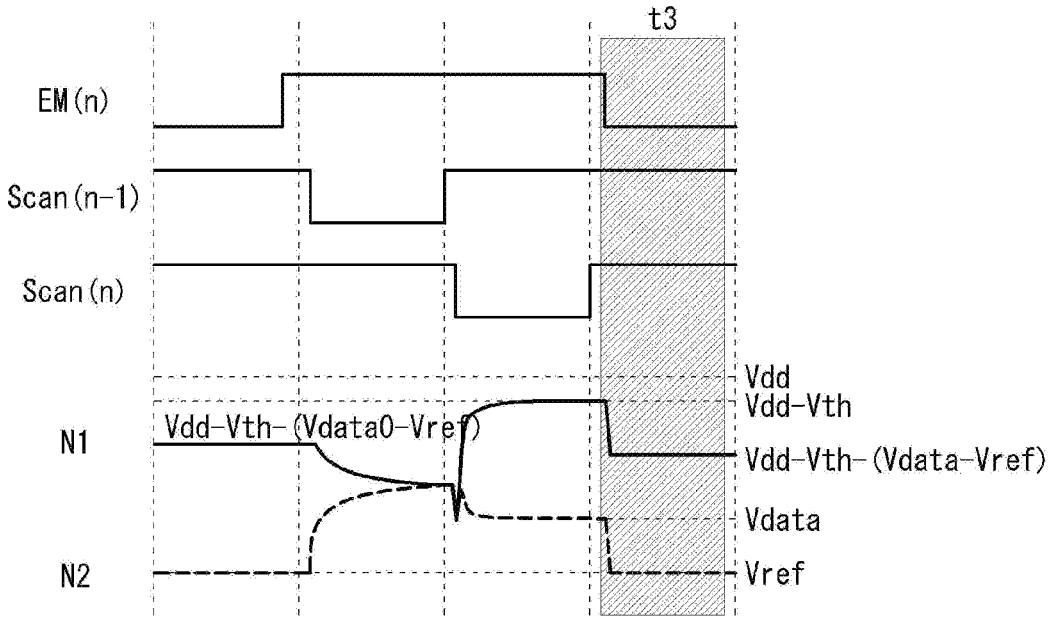

FIGS. 6, 7, and 8 show an initialization step, a program step, and a light emission step of the pixel circuit of FIG. 5, respectively, wherein the pixel circuit of FIG. 5 is controlled by a current scan signal Scan(n) for the current horizontal line, a previous scan signal Scan(n−1) for the previous horizontal line, and an emission signal EM.

The initialization period t1 of FIG. 6 is a period in which the first node N1 and the second node are initialized to receive the data voltage Vdata of the current frame in the state that the OLED of the pixel is emitting light with the data voltage Vdata0 of the previous frame.

Before the initialization period t1, the pixel circuit of FIG. 5 maintains the light emission state of the previous frame, so that the first node N1 has a predetermined voltage, that is, (Vdd−Vth−(Vdata0−Vref)) when the data voltage applied to the previous frame is Vdata0, and the second node N2 is connected to the reference voltage line through the third switching transistor T3 in a turn-on state to maintain the reference voltage Vref.

Immediately before the initialization period t1, the emission signal EM is changed from the gate low voltage VGL, which is the gate-on voltage, to the gate high voltage VGH, which is the gate-off voltage, and during the initialization period t1, the previous scan signal Scan(n−1) for applying the data voltage to the previous horizontal line is changed from a gate high voltage VGH, which is a gate-off voltage, to a gate low voltage VGL, which is gate-on voltage, and the current scan signal Scan(n) for applying the data voltage to the current horizontal line maintains the gate high voltage VGH, which is a gate-off voltage.

Accordingly, the third and fifth switching transistors T3 and T5 are changed from a turn-on state to a turn-off state, and the sixth switching transistor T6 is changed from a turn-off state to a turn-on state, and the first, second, and fourth switching transistors T1, T2, and T4 maintain a turn-off state.

In the initialization period t1, the third and fifth switching transistors T3 and T5 are turned off, so that a current path between the driving transistor DT and the OLED is cut off to cause the OLED to stop emitting light, and the sixth switching transistor T6 is turned on to form a closed circuit with the storage capacitor Cst, so that the voltages of the first node N1 and the second node N2 are the same.

Accordingly, the first node N1 and the second node N2 are equal to each other at a random voltage between (Vdd−Vth−(Vdata0−Vref)) of the first node N1 and the reference voltage Vref of the second node N2, and the storage capacitor Cst is in a state where there is no potential difference between both electrodes. The voltages of the first node N1 and the second node N2 are in a state without a potential reference point, and is determined by the capacity of the capacitor, the electric field applied to the capacitor, and the potential maintained in the previous light emission stage.

The program period t2 is a period in which the storage capacitor Cst stores the threshold voltage Vth of the driving transistor DT and the data voltage Vdata in both electrodes, that is, the first node N1 and the second node N2, respectively.

In the program period t2, the emission signal EM maintains a gate high voltage VGH, which is a gate-off voltage, and the previous scan signal Scan(n−1) is changed from a gate low voltage VGL, which is a gate-on voltage, to a gate high voltage VGH, which is a gate-off voltage, and the current scan signal Scan(n) is changed from a gate high voltage VGH, which is a gate off voltage to a gate low voltage VGL, which is a gate on voltage, slightly later than the previous scan signal Scan(n−1).

Accordingly, the first, second, and fourth switching transistors T1, T2, and T4 are changed from a turn-off state to a turn-on state; the third and fifth switching transistors T3 and T5 maintain a turned-off state; and the sixth switching transistor T6 is changed from a turn-on state to a turn-off state.

In the program period t2, the driving transistor DT is turned on in a diode-connected state by the first switching transistor T1 that is turned on, so that the voltage of the first node N1 increases and becomes a value (Vdd−Vth) obtained by subtracting the threshold voltage Vth of the driving transistor DT from the pixel driving voltage Vdd.

In addition, in the program period t2, the data voltage Vdata of the data line 14 is applied to the second node N2 by the second switching transistor T2 that is turned on, so that the second node N2 is fixed to the data voltage Vdata.

Therefore, charges corresponding to a difference between the data voltage Vdata and (Vdd−Vth) are stored in both electrodes of the storage capacitor Cst.

The light emission period t3 is a period in which the OLED emits light with an electric current corresponding to a voltage difference between the source electrode and the gate electrode of the driving transistor DT while applying the data voltage Vdata to the gate electrode of the driving transistor DT.

In the light emission period t3, the previous scan signal Scan(n−1) maintains a gate high voltage VGH, which is the gate-off voltage, and the current scan signal Scan(n) is changed from a gate low voltage VGL, which is a gate-on voltage to a gate high voltage VGH, which is a gate-off voltage, and the emission signal EM is changed from a gate high voltage VGH, which is a gate-off voltage, to a gate low voltage VGL, which is a gate-on voltage, slightly later than the current scan signal Scan(n).

Accordingly, the first, second, and fourth switching transistors T1, T2, and T4 change from a turn-on state to a turn-off state, and the third and fifth switching transistors T3 and T5 are changed from a turn-off state to a turn-on state, and the sixth switching transistor T6 maintains a turn-off state.

In the light emission period t3, since the third switching transistor T3 is turned on so that the second node N2 changes from the data voltage Vdata to the reference voltage Vref and the second electrode (second node N2) of the storage capacitor Cst is changed from the data voltage Vdata to the reference voltage Vref, the voltage of the first node N1 connected to the first electrode of the storage capacitor Cst is also changed by the amount of change (Vdata−Vref) in the voltage of the second node N2 to be changed from (Vdd−Vth) to (Vdd−Vth−(Vdata−Vref)).

In addition, in the light emission period t3, the fifth switching transistor T5 is turned on to form a current path between the driving transistor DT and the OLED, and the first electrode (or source electrode) of the driving transistor DT, and an electric current corresponding to a voltage difference between the gate electrode (first node N1) and the first electrode (or source electrode) of the driving transistor DT is applied to the OLED to emit the OLED. The light emission of the OLED is switched by the fifth switching transistor T5.

Since the source electrode of the driving transistor DT has a voltage value of Vdd, and the gate electrode has a voltage value of (Vdd−Vth−(Vdata−Vref)), the source-gate voltage Vsg of the driving transistor DT becomes (Vdd−(Vdd−Vth−(Vdata−Vref)))=(Vdata+Vth−Vref), and an electric current (I_OLED) proportional to the square of a value obtained by subtracting the threshold voltage Vth from the source-gate voltage Vsg of the driving transistor DT is proportional to a square of a value obtained by subtracting the reference voltage Vref from the data voltage Vdata as in Equation 1.

In order to accurately represent the luminance of the low gradation at a duty ratio of the emission signal EM, the emission signal EM swings between a gate-on voltage VGL and a gate-off voltage VGH at a predetermined duty ratio during the light emission period t3, thereby allowing the fifth switching transistor T5 to repeat an on/off operation.

In the pixel circuit of FIG. 5 unlike the pixel circuit of FIG. 2, since the first power supply line supplying the pixel driving voltage Vdd and the reference power line supplying the reference voltage are not directly connected to each other when initializing both electrodes of the storage capacitor Cst, as described with reference to FIGS. 6 to 8, no change occurs in the pixel driving voltage Vdd and the reference voltage Vref, so that there is no problem that the screen blinking is perceived by the user.

In addition, since the pixel circuit of FIG. 5 is controlled using only the scan signal Scan(n−1) of the previous horizontal line, the scan signal Scan(n) of the current horizontal line, and the emission signal EM, the gate driving circuit 13 creates just two control signals, that is, a scan signal and a light emission signal, whereby it is possible to solve a problem that the gate driving circuit 13 becomes large, and thus it is possible to reduce the bezel size.

In addition, since the scan signal of the previous horizontal line is used, the number of gate line wirings supplying the scan signal can be reduced, thereby reducing the complexity of the display panel 10 and lowering the aperture ratio of the pixel.

The display device described herein may be described as follows.

A display device according to an embodiment includes a display panel having a plurality of pixels; and a driving circuit supplying a scan signal and a light emission signal supplied through a gate line connected to pixels of each horizontal line of the display panel to drive the display panel, in synchronization with supply of a data voltage through a data line.

Each pixel may include a driving transistor generating an electric current corresponding to the data voltage; a light emitting element emitting light by the electric current; a first switching transistor sensing a threshold voltage of the driving transistor; a storage capacitor storing the data voltage and the threshold voltage in both electrodes thereof; a second switching transistor applying the data voltage of the data line to the storage capacitor; a third switching transistor initializing the storage capacitor to a reference voltage; a fourth switching transistor initializing the light emitting element to the reference voltage; a fifth switching transistor controlling a current flow between the driving transistor and the light emitting element; and a sixth switching transistor connecting both electrodes of the storage capacitor.

According to an embodiment, the driving circuit may divide one frame into an initialization period, a program period, and a light emission period to drive the pixel, and stop light emission of the light emitting element to make equal voltage across the storage capacitor in the initialization period. According to an embodiment, the driving circuit may turn off the third and fifth switching transistors and turn on the sixth switching transistor in the initialization period According to an embodiment, the driving circuit may store the threshold voltage in a first electrode of the storage capacitor and the data voltage in a second electrode of the storage capacitor in the program period. According to an embodiment, the driving circuit may turn on the first, second, and fourth switching transistors and turn off the sixth switching transistor in the program period.

According to an embodiment, the driving circuit may change the second electrode of the storage capacitor to the reference voltage and connect the driving transistor with the light emitting element to emit the light emitting element with an electric current corresponding to the data voltage, in the light emission period. According to an embodiment, the driving circuit may turn off the first, second, and fourth switching transistors and turn on the third and fifth switching transistors, in the light emission period.

According to an embodiment, the pixel may operate in response to a first scan signal supplied to apply the data voltage to a pixel disposed on a previous horizontal line rather than a current horizontal line in which the pixel is disposed, a second scan supplied to apply the data voltage to the pixel, and the light emission signal for controlling a current flow to the light emitting element.

According to an embodiment, the pixel may be provided so that a pixel driving voltage is supplied to the driving transistor, a low potential power supply voltage is supplied to the light emitting element, and the reference voltage is supplied to the third and fourth switching transistors.

According to an embodiment, the driving transistor may have a first electrode receiving the pixel driving voltage, a second electrode connected to the fifth switching transistor, and a gate electrode connected to a first electrode of the storage capacitor.

The light emitting element may have an anode electrode connected to the fifth switching transistor and a cathode electrode receiving the low potential power supply voltage.

The first switching transistor may have a gate electrode receiving the second scan signal, one of a first electrode and a second electrode connected to a gate electrode of the driving transistor, and the other connected to a second electrode of the driving transistor.

The second switching transistor may have a gate electrode receiving the second scan signal, a first electrode connected to the data line, and a second electrode connected to a second electrode of the storage capacitor.

The third switching transistor may have a gate electrode receiving the light emission signal, one of a first electrode and a second electrode connected to the second electrode of the storage capacitor, and the other receiving the reference voltage.

the fourth switching transistor may have a gate electrode receiving the second scan signal, one of a first electrode and a second electrode receiving the reference voltage, and the other connected to an anode electrode of the light emitting element.

The fifth switching transistor may have a gate electrode receiving the light emission signal, a first electrode connected to a second electrode of the driving transistor, and a second electrode connected to an anode electrode of the light emitting element.

The sixth switching transistor may have a gate electrode receiving the first scan signal, and one and the other of the first electrode and the second electrode connected to the first electrode and second electrode of the storage capacitor, respectively.

According to an embodiment, the driving circuit may divide one frame into an initialization period, a program period, and a light emission period to drive the pixel; the driving circuit may create the first scan signal as a gate-on voltage, the second scan signal as a gate-off voltage, and the light emission signal as the gate-off voltage, in the initialization period; the driving circuit may create the first scan signal as the gate-off voltage, the second scan signal as the gate-on voltage, and the light emission signal as the gate-off voltage, in the program period; and the driving circuit may create the first scan signal as the gate-off voltage, the second scan signal as the gate-off voltage, and the light emission signal as the gate-on voltage, in the light emission period.

According to an embodiment, the driving circuit may allow the light emission signal to swing between the gate-on voltage and the gate-off voltage at a predetermined duty ratio, in the light emission period.

Through the above description, those skilled in the art will appreciate that various changes and modifications are possible without departing from the technical spirit of the present invention. Therefore, the technical scope of the present invention is not limited to the contents described in the detailed description of the specification, but should be determined by the scope of the claims.

As described above, in the display device according to the present disclosure prevents the high voltage driving voltage and the reference voltage from being short-circuited to each other, thereby stabilizing the power supplied to the panel to improve display quality. In addition, it is possible to reduce the number of wirings that supply the scan signal for driving the pixel circuit, thereby reducing the reduction of the aperture ratio of the pixel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device, comprising:

a display panel having a plurality of pixels; and a driving circuit supplying a scan signal and a light emission signal supplied through a gate line connected to pixels from the plurality of pixels of each horizontal line of the display panel to drive the display panel, in synchronization with supply of a data voltage through a data line, wherein each pixel of the plurality of pixels includes:

a driving transistor generating an electric current corresponding to the data voltage;

a light emitting element emitting light by the electric current;

a first switching transistor sensing a threshold voltage of the driving transistor;

a storage capacitor storing the data voltage and the threshold voltage in both electrodes of the storage capacitor;

a second switching transistor applying the data voltage of the data line to the storage capacitor;

a third switching transistor initializing the storage capacitor to a reference voltage;

a fourth switching transistor initializing the light emitting element to the reference voltage;

a fifth switching transistor controlling a current flow between the driving transistor and the light emitting element; and a sixth switching transistor connecting both electrodes of the storage capacitor, wherein at least one of the plurality of pixels operates in response to a first scan signal supplied to apply the data voltage to another pixel from the plurality of pixels disposed on a previous horizontal line rather than a current horizontal line in which the at least one of the plurality of pixels is disposed, a second scan supplied to apply the data voltage to the at least one of the plurality of pixels, and the light emission signal for controlling a current flow to the light emitting element.

2. The display device of claim 1, wherein the driving circuit divides one frame into an initialization period, a program period, and a light emission period to drive at least one of the plurality of pixels, and stops light emission of the light emitting element to make equal voltage across the storage capacitor in the initialization period.

3. The display device of claim 2, wherein the driving circuit stores the threshold voltage in a first electrode of the storage capacitor and the data voltage in a second electrode of the storage capacitor in the program period.

4. The display device of claim 3, wherein the driving circuit changes the second electrode of the storage capacitor to the reference voltage and connects the driving transistor with the light emitting element to emit the light emitting element with an electric current corresponding to the data voltage, in the light emission period.

5. The display device of claim 4, wherein the driving circuit turns off the first switching transistor, the second switching transistor, and the fourth switching transistor and turns on the third switching transistor and the fifth switching transistor, in the light emission period.

6. The display device of claim 3, wherein the driving circuit turns on the first switching transistor, the second switching transistor, and the fourth switching transistor and turns off the sixth switching transistor in the program period.

7. The display device of claim 2, wherein the driving circuit turns off the third switching transistor and fifth switching transistor and turns on the sixth switching transistor in the initialization period.

8. The display device of claim 1, wherein the at least one of the plurality of pixels is provided so that a pixel driving voltage is supplied to the driving transistor, a low potential power supply voltage is supplied to the light emitting element, and the reference voltage is supplied to the third switching transistor and the fourth switching transistor.

9. The display device of claim 8, wherein the driving transistor has a first electrode receiving the pixel driving voltage, a second electrode connected to the fifth switching transistor, and a gate electrode connected to a first electrode of the storage capacitor;

the light emitting element has an anode electrode connected to the fifth switching transistor and a cathode electrode receiving the low potential power supply voltage;

the first switching transistor has a gate electrode receiving the second scan signal, one of a first electrode or a second electrode connected to a gate electrode of the driving transistor, and a remaining one of the first electrode or the second electrode connected to a second electrode of the driving transistor;

the second switching transistor has a gate electrode receiving the second scan signal, a first electrode connected to the data line, and a second electrode connected to a second electrode of the storage capacitor;

the third switching transistor has a gate electrode receiving the light emission signal, one of a first electrode and a second electrode connected to the second electrode of the storage capacitor, and the other receiving the reference voltage;

the fourth switching transistor has a gate electrode receiving the second scan signal, one of a first electrode and a second electrode receiving the reference voltage, and the other connected to an anode electrode of the light emitting element;

the fifth switching transistor has a gate electrode receiving the light emission signal, a first electrode connected to a second electrode of the driving transistor, and a second electrode connected to an anode electrode of the light emitting element; and the sixth switching transistor has a gate electrode receiving the first scan signal, and one and the other of the first electrode and the second electrode connected to the first electrode and second electrode of the storage capacitor, respectively.

10. The display device of claim 9, wherein the driving circuit divides one frame into an initialization period, a program period, and a light emission period to drive at least one of the plurality of pixels;

the driving circuit creates the first scan signal as a gate-on voltage, the second scan signal as a gate-off voltage, and the light emission signal as the gate-off voltage, in the initialization period;

the driving circuit creates the first scan signal as the gate-off voltage, the second scan signal as the gate-on voltage, and the light emission signal as the gate-off voltage, in the program period; and the driving circuit creates the first scan signal as the gate-off voltage, the second scan signal as the gate-off voltage, and the light emission signal as the gate-on voltage, in the light emission period.

11. The display device of claim 10, wherein the driving circuit allows the light emission signal to swing between the gate-on voltage and the gate-off voltage at a predetermined duty ratio, in the light emission period.

* * * * *